US006976596B2

(12) United States Patent
Brooks

(10) Patent No.: US 6,976,596 B2
(45) Date of Patent: Dec. 20, 2005

(54) DIVIDED OVEN RACK

(76) Inventor: Jean G Brooks, 5321 Glebe Street, Apartment 3, Halifax, NS (CA) B3X2P9

( * ) Notice: Subject to any disclaimer, the term of this patent is extended or adjusted under 35 U.S.C. 154(b) by 0 days.

(21) Appl. No.: 10/676,128

(22) Filed: Oct. 2, 2003

(65) Prior Publication Data

US 2004/0112852 A1 Jun. 17, 2004

(30) Foreign Application Priority Data

Oct. 24, 2002 (CA) ..... 2409623

(51) Int. Cl.[7] ..... A47F 5/08
(52) U.S. Cl. ..... 211/153; 211/181.1; 211/90.03
(58) Field of Search ..... 211/153, 88.02, 211/149, 90.03, 104, 90.02, 41.5, 41.6, 181.1, 211/119.003, 133.6, 132.1, 126.6, 133.5; 108/99, 167, 171, 115; 126/339

(56) References Cited

U.S. PATENT DOCUMENTS

| | | | | | |
|---|---|---|---|---|---|
| 593,889 | A | * | 11/1897 | Hom | 294/161 |
| 1,934,125 | A | * | 11/1933 | Hurt | 99/446 |
| 2,249,234 | A | * | 7/1941 | Srodulski | 312/42 |
| 2,299,885 | A | * | 10/1942 | Ellsworth et al. | 108/92 |
| 2,319,470 | A | * | 5/1943 | Nobles | 211/153 |
| 2,501,104 | A | * | 3/1950 | Smith | 99/449 |
| 2,517,385 | A | * | 8/1950 | Clark | 312/323 |
| 2,564,478 | A | * | 8/1951 | Harbison | 211/153 |
| 4,178,844 | A | * | 12/1979 | Ward et al. | 99/449 |
| 4,189,056 | A | * | 2/1980 | Majewski | 211/195 |
| 4,432,334 | A | * | 2/1984 | Holt | 126/9 B |
| 4,462,497 | A | * | 7/1984 | Maule | 211/7 |
| 4,553,523 | A | | 11/1985 | Stohrer, Jr. | |
| 5,131,547 | A | * | 7/1992 | Goldberg | 211/149 |
| 5,520,118 | A | * | 5/1996 | McCarthy | 108/42 |
| 6,112,916 | A | | 9/2000 | Barnes et al. | |
| 6,148,813 | A | | 11/2000 | Barnes et al. | |
| 6,349,717 | B1 | | 2/2002 | Thompson et al. | |
| 6,497,331 | B1 | * | 12/2002 | Morandi | 211/153 |
| 6,663,204 | B2 | * | 12/2003 | Atalla et al. | 312/408 |

* cited by examiner

*Primary Examiner*—Jennifer E. Novosad
(74) *Attorney, Agent, or Firm*—G. Ronald Bell & Associates

(57) ABSTRACT

A supporting rack includes rods arranged to form a planar grid pattern connected to allow for modification in the overall space occupied by the rack. In a preferred embodiment, a rack for use in a conventional domestic cooking oven is formed of perpendicularly disposed rods of material such as stainless steel enabled to withstand the temperatures to which such an oven may be subjected. The rack has an outer frame capable of interfacing with and supported by inside oven walls, and the individual rod sections being so connected as to allow folding or separation of the sections of the rack to reduce its size and facilitate handling when performing tasks such as cleaning the rack.

19 Claims, 2 Drawing Sheets

DIVIDED OVEN RACK

The present invention relates generally to an oven rack apparatus purposed to support food or containers of food while cooking in a conventional domestic oven. While the focus of discussion will be on a domestic oven, it should be clear that the apparatus and its use should not be restricted thereto. It can easily be envisioned that a rack as will be disclosed herein can be used for a number of other purposes. Examples of such, are outdoor barbeque grilling surface over a gas element or charcoal, indoor grilling surfaces, and baker's cooling racks.

The design and use of an oven rack in domestic ovens is well taught and documented in the art. Traditionally, the typical cleaning of such racks is difficult due to their rigid design and large overall size. Such cleaning whether effected indoors or outdoors, usually requires the use of a bathtub or suitably sized basin, to allow for complete submersion and proper cleaning.

DESCRIPTION OF THE PRIOR ART

Numerous oven racks of varying structures are known and form part of the prior art which support food and food containers inside domestic cooking ovens. In most cases, the racks are comprised of a stainless steel material arranged in a perpendicular grid fashion, and are rigid in their design. An example of a convention rack can be found in U.S. Pat. No. 6,112,916 dated Sep. 5, 2000 and entitled "Oven Rack" in which the entire frame is rigid and non-configurable and the rack is slid into and out of the oven in its fixed configuration.

U.S. Pat. No. 6,349,717 dated Feb. 26, 2002 and entitled "Oven Rack System Having Cutout Area and Insert Rack" and Canadian Patent No. 702309 dated Jan. 19, 1965 and entitled "Dual Purpose Oven Rack" teach variations of the conventional rack in which portions of the rack can be removed. However, unlike the invention taught herein, the intended purpose of these inventions is to allow flexible placement of food items in the oven cavity that may exceed the height allowed when using a one-piece rigid frame. In each of these inventions, the outer frame is still rigid and would ultimately remain difficult to handle outside the oven cavity.

U.S. Pat. No. 4,553,523 dated Nov. 19, 1985 and entitled "Two-Way Adjustable Grate and Method for Adjusting the Length and Width" and U.S. Pat. No. 6,148,813 dated Nov. 21, 2000 and entitled "Telescoping Oven Rack Assembly" disclose oven rack designs allowing configurable shapes. The former provides a rack capable of compression and extension in the plane, but is limited by the predefined size of each of the two components of the rack. The latter provides a telescoping component of the base rack for sliding outward of the oven cavity while the main rack remains in place. Neither the telescoping component nor the base component are substantially different in size and neither will fit in a standard kitchen sink or similar container for convenient cleaning and washing.

SUMMARY OF THE INVENTION

Thus, a primary object of the present invention is to provide a planar supporting surface comprising connection means adapted to allow connection of the planar surface with at least one other similar planar surface to form a unitary planar surface for supporting food or food containers. The connection means may take the form of a suitably structured hinge assembly or means for readily detaching one planar surface from another. The unitary planar supporting surface is adapted to be removably inserted into a cooking oven, and held in place therein. The area of the unitary planar supporting surface is of substantially the same area as a sum of areas of the planar surface and said at least one other similar surface.

A supporting rack comprises: a planar surface comprising a first and a second section; connection means adapted to allow connection of said planar surface sections to form a unitary planar supporting surface for supporting food or food containers; wherein said unitary planar supporting surface is adapted to be removably inserted into a cooking device, and maintained therein; and wherein said first and second surface sections are capable of being folded about said connection means or detached from each other to reduce the overall space occupied by the rack and to facilitate handling and storage of the rack.

The invention further contemplates a supporting rack, comprising: a planar surface comprising a first and a second section; connection means adapted to allow connection of said planar surface sections to form a unitary planar supporting surface for supporting food or food containers; wherein said unitary planar supporting surface is adapted to support said food or food containers above another planer surface; wherein said first and second surface sections are capable of being folded about said connection means or detached from each other to reduce the overall space occupied by the rack and to facilitate handling and storage of the rack.

The present invention contemplates and teaches the provision of a rack suitable for use in a domestic oven, or the like, which comprises a unitary surface embodying a plurality of rack-like supporting surfaces of convenient structure and dimensions such as to ensure ready foldability through hinged connection or ready detachability to disconnect one surface from the other. The rack may assume varying shapes in practice including rectangular, quadrilateral, circular, elliptical, a rack with rounded corners and perhaps others, providing the structural feature of ready detachability of one surface to another or the inclusion of a hinged connection to enable ready folding of one larger rack surface into two smaller surfaces to facilitate cleaning thereof.

In a preferred embodiment the rack of the present invention preferably includes rods comprised of stainless steel materials. Alternatively, the rack may include rods comprising aluminum alloys capable of withstanding heat normally developed in a domestic oven or other such heated equipment.

The rack of the present invention preferably includes a plurality of rods arranged in perpendicular disposition.

However, rack structures falling within the scope of the present invention embodying rods of non-perpendicular disposition may also be found workable in practice providing the overall structure includes the feature of the ready detachability of one planar surface from another as previously taught herein or the provision of a hinged connection to ensure foldability of one larger planar rack surface into two smaller surfaces.

The rack of the present invention preferably includes a joining or hinged mechanism comprising a joint wherein the plurality of rods of one of the at least two smaller sections connect with or slide into the corresponding rods of another one of the at least two smaller sections. In one preferred structure the hinge connection includes a channel passing through corresponding ends of two smaller sections of the rack so that they assume an in-line and operable connection when joined, and secured so that at least one securing pin is passing through the channel to effect connection.

The rack of the present invention is preferably structured so that in use the, at least two smaller sections of the rack, may be readily and conveniently submersed in a standard kitchen sink or alternative washing or cleaning vehicle to facilitate cleaning of unwanted material from the rack.

The rack of the present invention is preferably and indeed normally used in practice to support food or food containers inside a domestic cooking oven. It is also envisioned that the rack of the present invention may be used to support food or food containers on an outdoor cooking grill comprising a heat source of any one of gas, charcoal or the like. In addition, the rack may be used to support food or food containers to allow for proper ventilation in the normal cooling process.

BRIEF DESCRIPTION OF THE DRAWINGS

Embodiments of the present invention will be further described with reference to the accompanying drawings, in which.

DETAILED DESCRIPTION OF THE DRAWINGS

Figure 1:
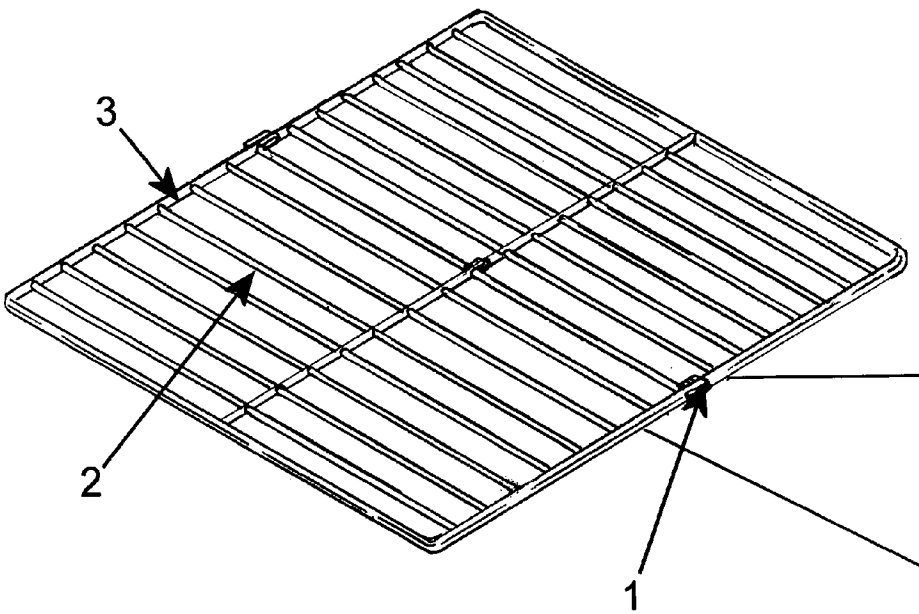
FIG. 1 is a perspective view of an embodiment of the oven rack of the present invention.

FIG. 1 shows an exemplary embodiment of the oven rack of the present invention. The oven rack comprises an outside frame 3, cross rods 2, and a joining mechanism 1. The outside frame 3 is a rectangular shape with rounded corners containing a centrally located rod parallel to the longer sides of the rectangle. Each of these three rods are divided near their centre to allow for the joining mechanism 1. Cross rods 2 extend perpendicularly from the three longer rods, connecting the centre rod to each of the outside rods, resulting in a grid pattern.

Figure 2:
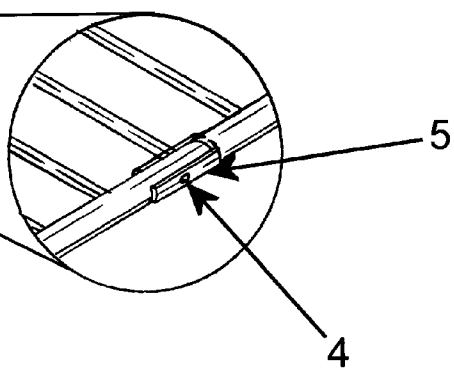
FIG. 2 is a perspective view of a hinged mechanism allowing separation of the halves of the rack in accordance with the present invention.

FIG. 2 shows an amplified view of the joining mechanism 1 in which the mechanics of the joint are evident. It is shown that the joining mechanism 1 is made up of a rest 5 extending from the ends of one half of the outer frame, allowing the support of the corresponding ends of the other half of the outer frame, and a channel 4 through which a pin may pass to secure the connection of the corresponding ends.

Figure 3:
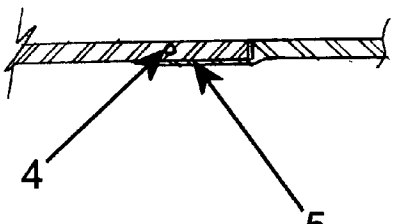
FIG. 3 is a side view of a hinged mechanism allowing separation of the halves of the rack in accordance with the present invention.

FIG. 3 also shows an amplified view of the joining mechanism 1, provided from a side angle. FIG. 3 is provided to demonstrate the level of overlap present between the corresponding ends of the two halves and the relative position of the securing pin 4.

Figure 4:
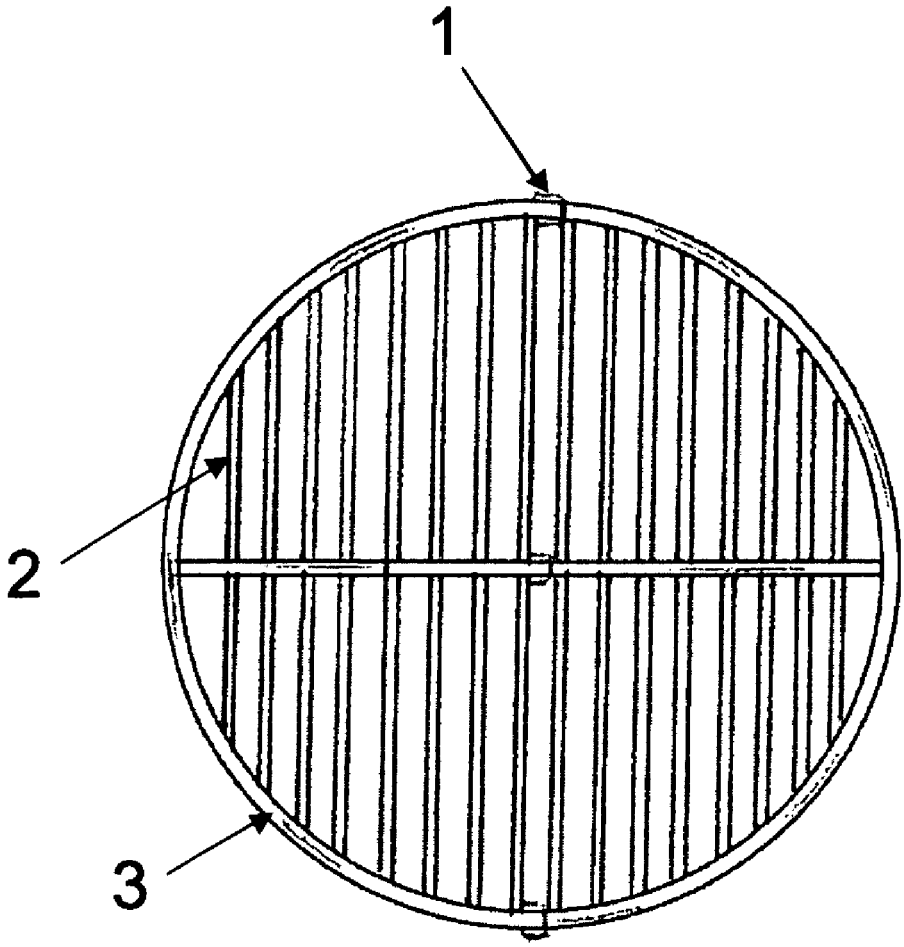
FIG. 4 is a top plan view of an embodiment of the oven rack of the present invention.

FIG. 4 illustrates an embodiment of the present invention wherein the outside frame 3 is circular or elliptical in shape and contains a centrally located rod extending over the diameter of the circle.

What is claimed is:

1. A supporting rack, comprising:

a planar surface comprising a first and a second section, whereby each section is defined by a plurality of cross rods and a plurality of mutually engaged rods that are disposed perpendicularly to the cross rods;

connection means adapted to allow connection of said planar surface sections to form a unitary planar supporting surface for supporting food or food containers;

wherein said unitary planar supporting surface is structured to facilitate removable insertion into a cooking apparatus;

wherein said connection means comprises the plurality of mutually engaged rods, said first and second sections being connected at at least one joint wherein said at least one joint being formed by insertion of an end portion of one of said plurality of mutually engaged rods of said first sections into an end portion of one of said plurality of mutually engaged rods of said second sections, a channel passes through each of said end portions of said mutually engaged rods of said first and second sections and the channels assume an in-line position when said sections are joined together, and the end portions are secured with at least one securing pin passing through the channels; and wherein said first and second surface sections are capable of being folded about said connection means or detached from each other to reduce the overall space occupied by the rack and to facilitate handling and storage of the rack.

2. A supporting rack according to claim 1, wherein said first and second surface sections are substantially similar in size.

3. A supporting rack according to claim 1, wherein said first and second surface sections are of different sizes.

4. A supporting rack according to claim 1, wherein said cooking apparatus is a domestic or commercial cooking oven.

5. A supporting rack according to claim 1, wherein said cooking apparatus is an outdoor grilling device.

6. A supporting rack according to claim 1, comprising an outer frame adapted to interface with supporting slots provided along inner walls of an oven cavity.

7. A supporting rack according to claim 1, comprising an outer frame adapted to interface with supporting slots provided along inner walls of a grilling device.

8. A supporting rack according to claim 1, comprising an overall quadrilateral or rectangular shape.

9. A supporting rack according to claim 8, comprising rounded corners.

10. A supporting rack according to claim 1, comprising an overall circular or elliptical shape.

11. A supporting rack according to claim 1, comprising a solid supporting surface.

12. A supporting rack according to claim 11, wherein said solid supporting surface includes an array of apertures to allow heat or air passage.

13. A supporting rack according to claim 1, wherein said supporting rack is formed of stainless steel.

14. A supporting rack according to claim 1, wherein said supporting rack is formed of aluminum.

15. A supporting rack according to claim 1, wherein said connection means comprises at least one hinge; said hinge allowing a user to fold said sections of said planar supporting surface.

16. A supporting rack, comprising:

a planar surface comprising a first and a second section, whereby each section is defined by a plurality of cross rods and a plurality of mutually engaged rods that are disposed perpendicularly to the cross rods;

connection means adapted to allow connection of said planar surface sections to form a unitary planar supporting surface for supporting food or food containers;

wherein said unitary planar supporting surface is structured to support said food or food containers above another planar surface;

wherein said connection means comprises the plurality of mutually engaged rods, said first and second sections being connected at at least one joint wherein said at least one joint being formed by insertion of an end portion of one of said plurality of mutually engaged rods of said first sections into an end portion of one of said plurality of mutually engaged rods of said second sections, a channel passes through each of said end portions of said mutually engaged rods of said first and second sections and the channels assume an in-line position when said sections are joined together, and the end portions are secured with at least one securing pin passing through the channels; and wherein said first and second surface sections are capable of being folded about said connection means or detached from each other to reduce the overall space occupied by the rack and to facilitate handling and storage of the rack.

17. A supporting rack according to claim 16, wherein said first and second surface sections are substantially similar in size.

18. A supporting rack according to claim 16, wherein said first and second surface sections are of different sizes.

19. A supporting rack according to claim 16, wherein said connection means comprises at least one hinge; said hinge allowing a user to fold said sections of said planar supporting surface.

* * * * *